US012570339B2

(12) United States Patent
Chen et al.

(10) Patent No.: US 12,570,339 B2
(45) Date of Patent: Mar. 10, 2026

(54) GLOBAL TRAIN-LOCALIZATION SYSTEM

(71) Applicant: CASCO SIGNAL LTD., Shanghai (CN)

(72) Inventors: Shaowen Chen, Shanghai (CN); Yu Zhang, Shanghai (CN); Xiaoyong Wang, Shanghai (CN); Cong Shi, Shanghai (CN); Juan Chai, Shanghai (CN); Yiran Lu, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 642 days.

(21) Appl. No.: 18/003,498

(22) PCT Filed: Sep. 22, 2021

(86) PCT No.: PCT/CN2021/119550

§ 371 (c)(1),
(2) Date: Dec. 27, 2022

(87) PCT Pub. No.: WO2022/198945

PCT Pub. Date: Sep. 29, 2022

(65) Prior Publication Data

US 2023/0242165 A1 Aug. 3, 2023

(30) Foreign Application Priority Data

Mar. 23, 2021 (CN) ..... 202110310834.2

(51) Int. Cl.
*B61L 25/02* (2006.01)
*B61L 27/70* (2022.01)

(52) U.S. Cl.
CPC ..... *B61L 25/025* (2013.01); *B61L 27/70* (2022.01)

(58) Field of Classification Search
CPC ..... B61L 25/025; B61L 27/70
See application file for complete search history.

(56) References Cited

U.S. PATENT DOCUMENTS 8,477,067 B2 * 7/2013 Kanner ..... G01S 19/11 342/357.29
11,753,054 B2 * 9/2023 Green ..... B61L 23/34 701/19

(Continued)

FOREIGN PATENT DOCUMENTS

CN 2011183937 A 9/2011
CN 106394617 A * 2/2017 ..... B61L 25/028

(Continued)

OTHER PUBLICATIONS

International Search Report (with English translation) and Written Opinion issued in PCT/CN2021/119550, dated Dec. 3, 2021, 10 pages provided.

*Primary Examiner* — Jason C Smith
(74) *Attorney, Agent, or Firm* — HSML P.C.

(57) ABSTRACT

The present disclosure relates to a global train-localization system. The system may autonomously send a precise location of a train to effectively cope with train location recognition in a case of various faults or degradations. The localization system includes: a backup localization unit installed on the train and configured to read beacon location information on a track; and a global train-localization system (GTS) server configured to receive, store and convert train localization information sent by the backup localization unit and to perform output and display. Compared to the prior art, the present disclosure has the advantages of effectively coping with system degradation, namely, tracking the location of the train in real time even in a case of complete fault of a signal system, etc.

7 Claims, 2 Drawing Sheets

(56) References Cited

U.S. PATENT DOCUMENTS

| | | | | |
|---|---|---|---|---|
| 11,866,075 | B2 * | 1/2024 | Hammerl | B61L 25/021 |
| 2009/0105893 | A1 * | 4/2009 | Kernwein | B61L 25/025 701/19 |
| 2022/0097745 | A1 * | 3/2022 | Tsuchida | B61L 23/16 |
| 2023/0242165 | A1 * | 8/2023 | Chen | B61L 27/70 246/122 R |
| 2023/0249727 | A1 * | 8/2023 | Lu | B61L 15/0072 701/19 |
| 2023/0278610 | A1 * | 9/2023 | Xing | B61L 19/06 246/4 |

FOREIGN PATENT DOCUMENTS

| | | | | | |
|---|---|---|---|---|---|
| CN | 111016975 | A | * | 4/2020 | B61L 25/021 |
| CN | 112249097 | A | * | 1/2021 | B61L 27/20 |
| CN | 113022652 | A | | 6/2021 | |
| EP | 2724180 | B1 | * | 9/2016 | G01S 19/11 |
| ES | 2205101 | T3 | * | 5/2004 | B61L 25/025 |
| GB | 2479900 | A | * | 11/2011 | B61L 25/026 |
| KR | 20100030424 | A | * | 3/2010 | B61L 15/0036 |

* cited by examiner

GLOBAL TRAIN-LOCALIZATION SYSTEM

TECHNICAL FIELD

The present disclosure relates to a train localization system, in particular to a global train-localization system.

BACKGROUND

In most of current communication based train control (CBTC) systems, a system architecture based on axle counter equipment and interlocking equipment is used. There are two ways of train localization as follows:

1) active reporting, where a train calculates its precise location according to a distance of train operation by reading a wayside beacon; and
2) passive detection, where the occupation of the train in a section is detected via a track circuit or axle counter equipment to indirectly obtain the location of the train, it only can be recognized that the train is in a certain section, and the precise location of the train cannot be obtained.

In general, the train actively reports its location. Once active reporting cannot be completed, passive indirect detection may be performed. However, both the active reporting and the passive detection are completed in a case where equipment for location detection has no fault. In a case of the following degradation, the system cannot obtain the location of the train, and once the system cannot determine the location of the train, train operation will be impossible, which causes a greater impact on the operation, where the degradation includes:

1) axle counter equipment has a fault;
2) interlocking equipment has a fault; or
3) main carborne equipment has a fault.

In addition, precise train localization is only limited to single line or some lines with interconnection and interworking conditions. If the train transfers to other line, it cannot send its precise localization information; and engineering trains or special trains also cannot be precisely localized.

SUMMARY

To overcome the above defects existing in the prior art, an objective of the present disclosure is to provide a global train-localization system.

The objective of the present disclosure may be achieved through the following technical solution:

According to one aspect of the present disclosure, a global train-localization system is provided. The system may autonomously send a precise location of a train to effectively cope with train location recognition in a case of various faults or degradations. The localization system includes:

- a backup localization unit installed on the train and configured to read beacon location information on a track; and
- a global train-localization system (GTS) server configured to receive, store and convert train localization information sent by the backup localization unit and to perform output and display.

As a preferred technical solution, the backup localization unit is a set of localization processing system independent of a carborne system, includes an independent power supply and an independent ring network, and is connected to the GTS server by means of a redundant wireless network.

As a preferred technical solution, the backup localization unit is connected to a beacon antenna to upload the read beacon location information to the GTS server via a train-ground wireless link.

As a preferred technical solution, the uploaded information includes a train number, a beacon number, and a line number.

As a preferred technical solution, the localization system may achieve single-line-level train location tracking and line-network-level train location tracking.

As a preferred technical solution, the single-line-level train location tracking is specifically achieved as follows:

- all trains on a single line are equipped with backup localization units to achieve location tracking of all the trains; and
- meanwhile a control center is configured with a set of GTS server to receive localization information of the trains and perform real-time display on a display terminal.

As a preferred technical solution, all the trains include electric passenger trains, engineering trains, or special trains.

As a preferred technical solution, the line-network-level train location tracking is specifically achieved as follows: line configuration is set in a unified way at a line network level to achieve the line-network-level train location tracking.

As a preferred technical solution, the setting specifically includes:

- setting beacon identities (IDs) of beacons in a unified way according to the number of beacons on different lines;
- setting a unified interface protocol;
- dividing, by the backup localization unit, different network segments according to the lines, and setting a network address in a unified way; and
- cascading single-line-level GTS servers to achieve line-network-level train localization and real-time tracking.

As a preferred technical solution, the setting a unified interface protocol includes: setting a protocol between the backup localization unit and the beacon antenna; setting a protocol between the backup localization unit and the GTS server; and setting a protocol between a beacon message and a code.

Compared to the prior art, the present disclosure has the following advantages:

1) System degradation is effectively coped with, namely, the location of the train can be tracked in real time even in a case of complete fault of a signal system (including an interlocking system, an axle counter or track circuit, a carborne automatic train control (ATC) or automatic train supervision (ATS) system).
2) Interconnection and interworking and carborne equipment, namely, backup localization units (BLUs) are interchanged, which effectively solves the problem that the precise location of the train in transfer operation cannot be obtained.
3) Powerful functions are achieved, and a global dispatching and command platform may achieve unified command of a single line level and a line network level.
4) High redundancy is achieved, and high reliability of the system is achieved by arranging an independent redundant wireless unit, the independent power supply, and the independent ring network.

DETAILED DESCRIPTION OF THE EMBODIMENTS

The technical solutions in the embodiments of the present invention will be clearly and completely described below with reference to the accompanying drawings in the embodiments of the present disclosure. Apparently, the described embodiments are part rather than all of the embodiments of the present disclosure. All other embodiments obtained by those of ordinary skill in the art based on the embodiments of the present disclosure without creative efforts should fall within the scope of protection of the present disclosure.

A global train-localization system (GTS) in the present disclosure is configured for line-network-level train localization and tracking. A train equipped with the GTS may autonomously send a precise location of a train to effectively cope with train location recognition in a case of various faults or degradations.

Figure 1:
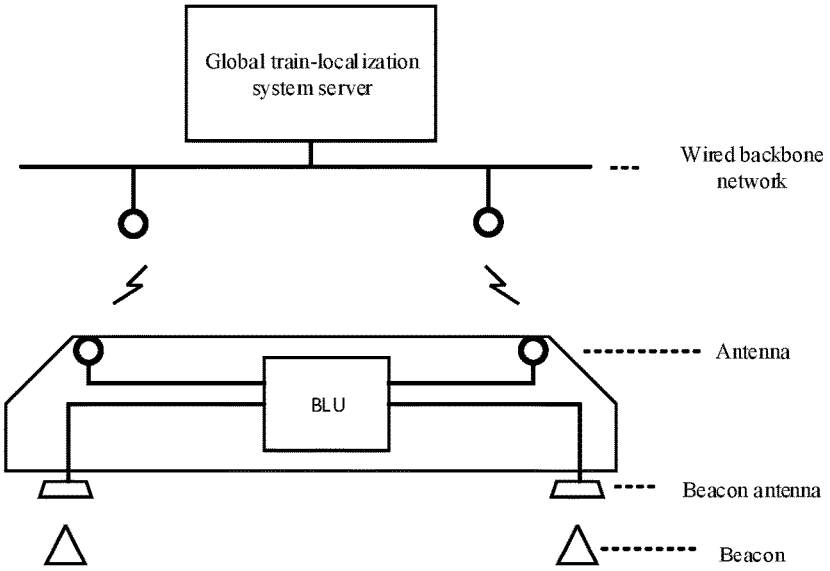
FIG. 1 is a schematic structural diagram of the present disclosure.

As shown in FIG. 1, the global train-localization system mainly includes the following equipment:

1) a backup localization unit (BLU) that is installed on the train, is a set of localization processing system independent of a carborne system, is connected to a beacon antenna, and is configured to read beacon location information on a track and to upload the information to the ground via a train-ground wireless link, where the uploaded information includes a train number, a beacon number, and a line number; and 2) a global train-localization system (GTS) server configured to receive, store and convert train localization information sent by the BLU and to perform output and display.

The GTS may achieve single-line-level train location tracking and line-network-level train location tracking.

Figure 2:
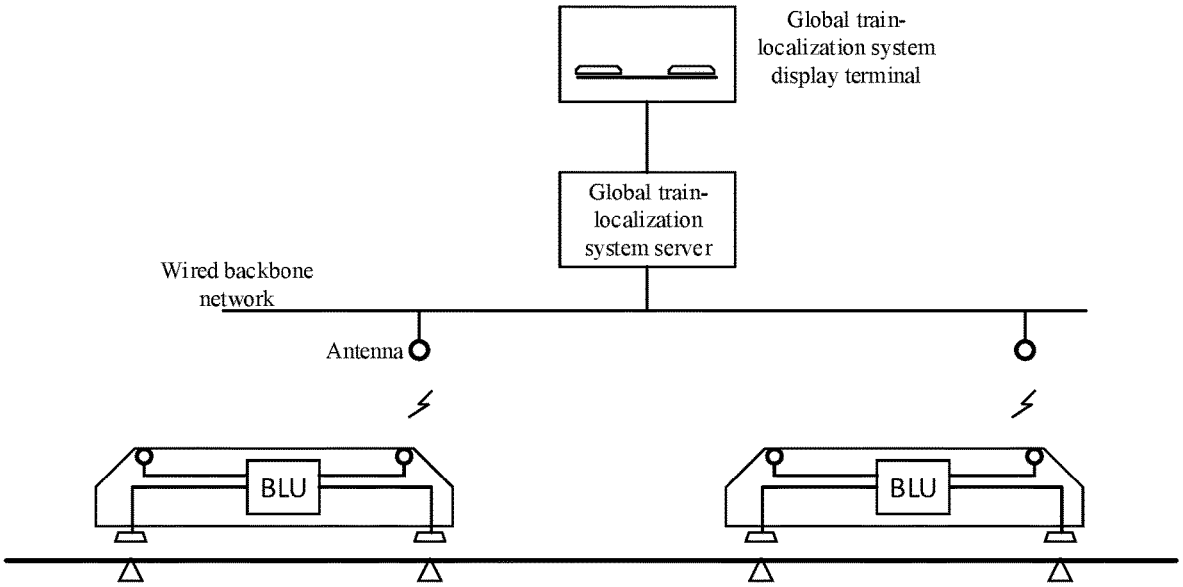
FIG. 2 is a schematic diagram of single-line-level global train-localization system (GTS) configuration.

1) As shown in FIG. 2, a single line level is specifically as follows:

all trains on a single line are equipped with GTSs to achieve location tracking of all the trains (including electrical passenger trains, engineering trains, or other special trains); and a control center is configured with a set of GTS server to receive localization information of the trains and perform real-time display on a GTS display terminal.

Figure 3:
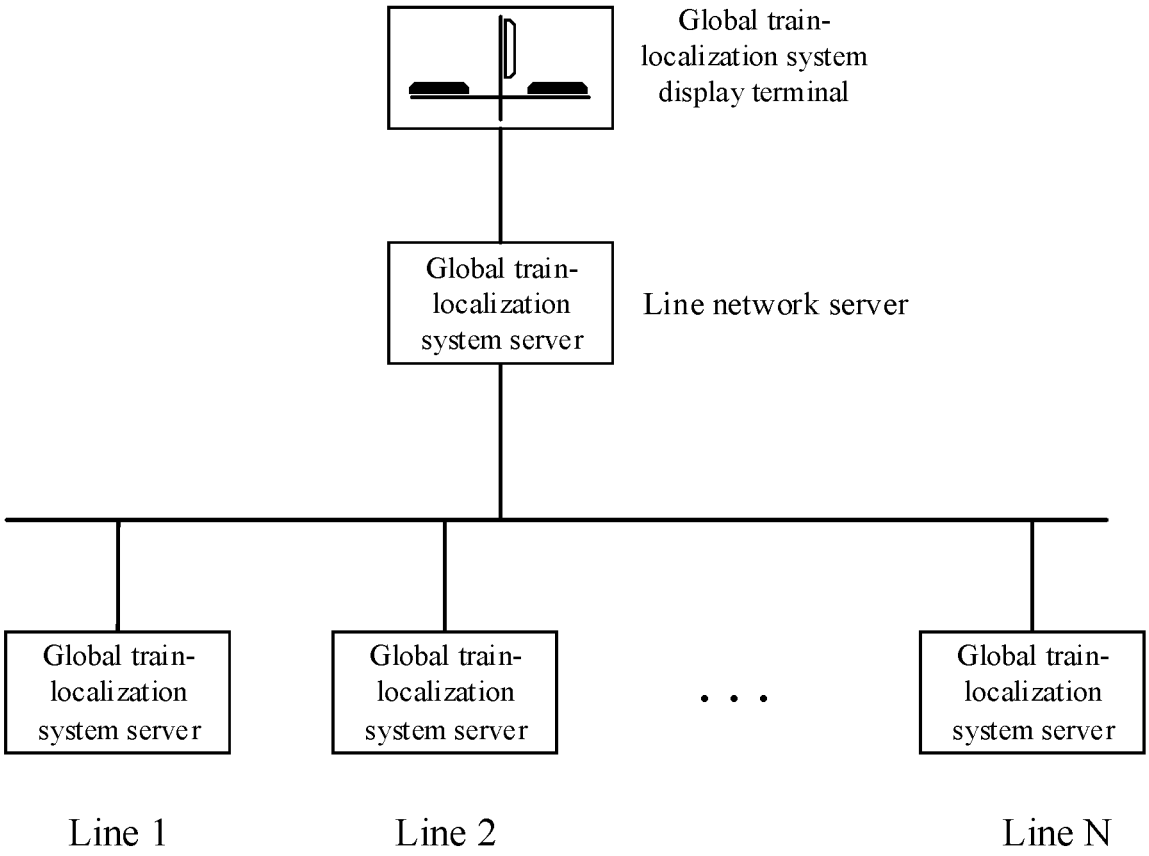
FIG. 3 is a schematic diagram of line-network-level GTS configuration.
Figure 4:
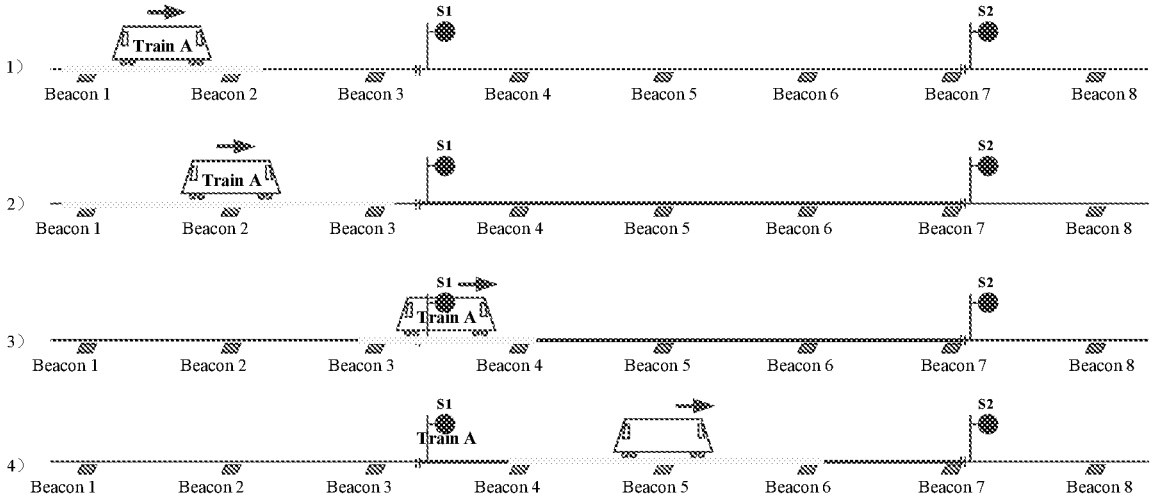
FIG. 4 is a schematic diagram of a specific example of the present disclosure.

2) As shown in FIG. 3, a line network level is specifically as follows:

Line configuration is planned in a unified way at the line network level to achieve line-network-level train location tracking. The planning includes the following aspects:

planning identities (IDs) of beacons in a unified way according to the number of beacons on different lines;

unifying interface protocols including a protocol between the BLU and the beacon antenna, a protocol between the BLU and the GTS server, and a protocol between a beacon message and a code;

dividing, by the BLU of the train, different network segments according to the lines, and planning a network address in a unified way; and cascading single-line-level GTS servers to achieve line-network-level train localization and real-time tracking.

This example is one of application scenarios of the GTS. This scenario is an example where a train A is manually driven, degraded and unserviceable and an axle counter section has a fault.

1) During the manual driving of the train, since the GTS is independent of the carborne system and obtains the location of the train via the beacon, the train sends the localization information in real time under normal circumstances, and the train is between a beacon 1 and a beacon 2.

2) After the train crosses the beacon 2, the system recognizes that the train is between the beacon 1 and a beacon 3, and the axle counter section in the front is occupied due to the fault.

3) After the train enters the faulty axle counter section, the system may recognize that the train is between the beacon 3 and a beacon 4; and in the absence of the GTS, a signal system cannot recognize the specific location of the train, or even whether the train is in the faulty section.

4) The train continues to operate in the faulty section. After the train crosses a beacon 5, the system may recognize that the train is between the beacon 4 and the beacon 5.

The above is only the specific implementation of the present disclosure, but the scope of protection of the present disclosure is not limited thereto. Any of those skilled in the art may easily think of various equivalent modifications or substitutions within the technical scope of the present disclosure, and these modifications or substitutions should be included in the scope of protection of the present disclosure. Therefore, the scope of protection of the present disclosure should be subject to the appended claims.

The invention claimed is:

1. A global train-localization system, the system being configured to send location of a train in a case of equipment failure, the localization system comprising:

a backup localization unit (BLU) installed on the train and configured to read beacon location information on a track; and a global train-localization system (GTS) server configured to receive, store, and convert train location information sent by the BLU and to perform output and display, wherein the localization system is configured to perform train location tracking of trains in a single train line and train location tracking of trains in a network of train lines, wherein train location tracking of trains in the network of train lines includes configuring train lines in the network by:

configuring beacon identities (IDs) of beacons based on a number of beacons on the train lines in the network;

configuring interface protocols including an interface protocol between the BLU and a beacon antenna, an interface protocol between the BLU and the GTS server, and an interface protocol of a beacon message and the beacon coding;

the BLU dividing the train lines into network segments and configuring network addresses for the network segments; and cascading the GTS server in the single train line to perform train location tracking of trains in the network of train lines in real-time, wherein during manual driving of the train, the GTS server is independent of the carborne system and obtains location information of the train via the beacon, the train sends location information in real-time where the train is between beacon 1 and beacon 2, after the train crosses beacon 2, the train is determined to be between beacon 1 and beacon 3, and an axle counter section becomes occupied due to the equipment failure, after the train enters the axle counter section, the train is determined to be between beacon 3 and beacon 4 due to the use of the GTS server, and the train continues to operate in the axle counter section, after the train crosses beacon 5, the train is determined to be between beacon 4 and beacon 5.

2. The global train-localization system according to claim 1, wherein the BLU is a set of localization processing systems independent of a carborne system, comprises an independent power supply and an independent ring network, and is connected to the GTS server via a redundant wireless network.

3. The global train-localization system according to claim 1, wherein the BLU is connected to a beacon antenna, is configured to read beacon location information on a track and to upload the read beacon location information to the GTS server via a train-ground wireless link.

4. The global train-localization system according to claim 3, wherein the uploaded information comprises a train number, a beacon number, and a line number.

5. The global train-localization system according to claim 1, wherein the equipment failure includes a failure of axle counter equipment, a failure of interlocking equipment, or a failure of carborne equipment.

6. The global train-localization system according to claim 1, wherein to perform train location tracking of trains in the single train line, each of the trains on the single train line includes a BLU; and meanwhile a control center is configured with a set of GTS servers to receive location information of the trains and display the location information on a display terminal in real-time.

7. The global train-localization system according to claim 6, wherein the tracked trains include at least one of electric passenger trains, engineering trains, or special trains.

* * * * *